US005719350A

United States Patent [19]

Parkes et al.

[11] Patent Number: 5,719,350

[45] Date of Patent: Feb. 17, 1998

[54] BLAST AND SPLINTER PROOF SCREENING DEVICE AND HIS METHOD OF USE

[75] Inventors: John Humphries Parkes, Redhall Mill Cottage, Colinton Dell Edinburgh, Great Britain; Stephen Hugh Salter, Edinburgh, Great Britain

[73] Assignee: John Humphries Parkes, Colinton Dell, United Kingdom

[21] Appl. No.: 436,438

[22] PCT Filed: Sep. 23, 1994

[86] PCT No.: PCT/GB94/02079

§ 371 Date: Oct. 16, 1995

§ 102(e) Date: Oct. 16, 1995

[87] PCT Pub. No.: WO95/08749

PCT Pub. Date: Mar. 30, 1995

[30] Foreign Application Priority Data

| | | | |
|---|---|---|---|
| Sep. 24, 1993 | [GB] | United Kingdom | 9319708 |
| Nov. 24, 1993 | [GB] | United Kingdom | 9324203 |
| Aug. 15, 1995 | [GB] | United Kingdom | 9416429 |

[51] Int. Cl.[6] ..... F24D 5/00

[52] U.S. Cl. ..... 102/303

[58] Field of Search ..... 102/303

[56] References Cited

U.S. PATENT DOCUMENTS

| | | | |
|---|---|---|---|
| 2,699,117 | 1/1955 | La Prairie . | |
| 3,106,159 | 10/1963 | Abramson | 102/30 |
| 3,806,025 | 4/1974 | Marshall | 229/62.5 |
| 4,543,872 | 10/1985 | Graham et al. | 86/1 B |
| 4,589,341 | 5/1986 | Clark et al. | 102/303 |
| 4,836,079 | 6/1989 | Barrett | 86/50 |
| 4,889,258 | 12/1989 | Yerushalmi | 220/429 |
| 4,905,601 | 3/1990 | Gabriel et al. | 102/307 |
| 5,225,622 | 7/1993 | Gettle et al. | 86/50 |

FOREIGN PATENT DOCUMENTS

| | | |
|---|---|---|
| 0 276 918 | 8/1988 | European Pat. Off. . |
| 1164339 | 10/1958 | France . |
| 1444100 | 5/1966 | France . |
| 1584977 | 10/1970 | France . |
| 2 295 299 | 7/1976 | France . |
| A1 31 12729 | 10/1982 | Germany . |
| 543 069 | 11/1973 | Switzerland . |
| 1 516 640 | 7/1978 | United Kingdom . |

OTHER PUBLICATIONS

Database WPI, Week 7825, Derwent Publications Ltd., London, Great Britain; AN 78–E9703A & ZA, A, 7 650 622 (T. Wilson).

*Primary Examiner*—Peter A. Nelson

*Attorney, Agent, or Firm*—Calfee, Halter & Griswold LLP

[57] ABSTRACT

This invention relates to the use of at least one rupturable flexible liquid containment device to reduce the effects of explosions. It has applications, inner alia, in the control of "fly" from building demolition, the disposal of munitions, the disposal of used but unexploded weapons and the suppression of terrorist bombs.

20 Claims, 6 Drawing Sheets

BLAST AND SPLINTER PROOF SCREENING DEVICE AND HIS METHOD OF USE

DESCRIPTION OF THE INVENTION

Figure 1:
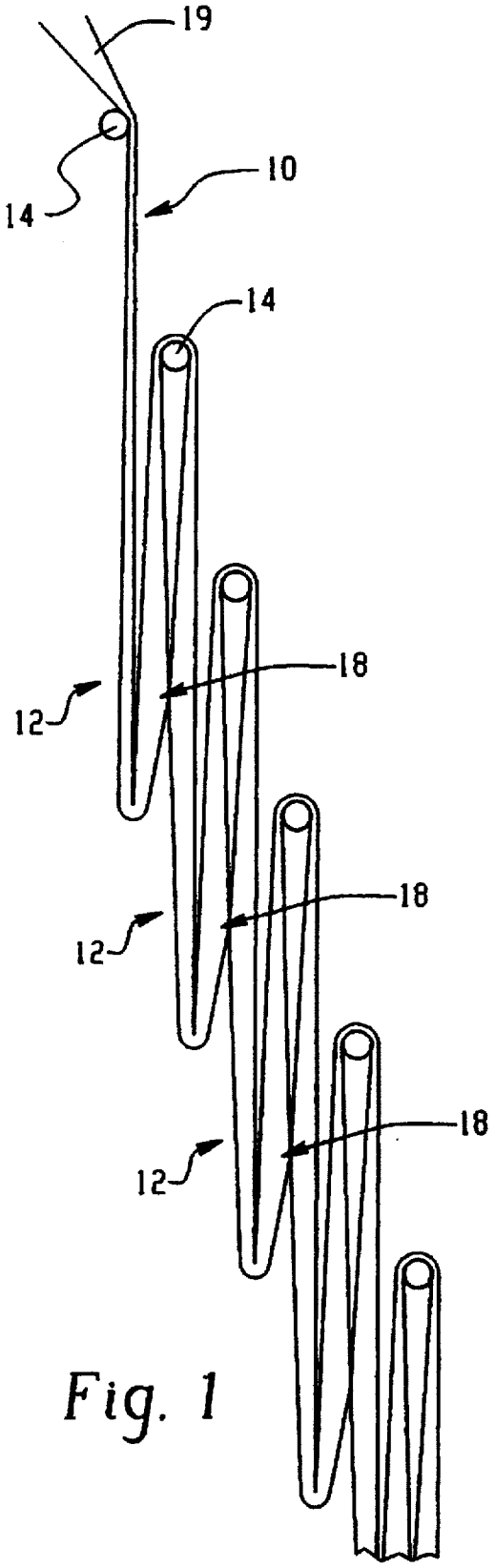

Throughout this specification the term "fly" is used describe material ejected from the site of an explosion into an adjacent area.

In the case of using explosives to demolish building structures, the "fly" will typically be pieces of the building structure close to the site of the detonation but it can also include objects or parts of objects placed adjacent to the charge to be detonated for the purpose of "fly" suppression. It is conventional practice to suppress "fly" created by an explosive blast and articles such as sand bags, old tires, bales of straw, old vehicles, conveyor belting, submarine nets and loose sand have all been used for this purpose. It is also self-evident that in the case of an explosion conducted below the surface of a body of water, the water itself serves to suppress "fly".

In view of a recent unfortunate accident in the U.K. involving the death of a spectator to the explosive demolition of a high-rise building, the question of "fly" suppression has received considerable publicity and one important aspect of this invention is concerned with a novel method of suppressing the incursion of "fly" into an area to be protected, a novel method of preparing a building structure for explosive demolition and to novel equipment for employment in the aforementioned methods.

Expressed as a method of suppressing the incursion of "fly" from a detonation charge into an area to be protected invention includes locating a volume of liquid contained in a flexible-walled container between the charge and the said area prior to detonation of the charge.

In accordance with this aspect of the invention a method of preparing a building structure for explosive demolition comprises locating empty flexible-walled containers between at least one site of an explosive charge in the structure and its surroundings, introducing a volume of liquid into the flexible containers to expand them and subsequently detonating the charge. Since the operation of all methods in accordance with this invention are likely to involve large volumes of liquid, water is preferred, typically mains water but river- or sea-water is clearly also usable.

Equipment comprising an unfilled arrangement of flexible containers and a support structure therefor designed for employment in accordance with either of the foregoing methods constitutes a further aspect of this invention.

Flexible-walled containers filled with liquid can also be used to shield an object which is liable to explode and to provide apparatus for forming a protective shield around such an object. The protected object could be, for example, munitions for disposal, an unexploded weapon or a co-called "car bomb". In this specification by the term "car bomb" is meant a vehicle with a bomb or explosive device attached to, inside, or in the vicinity of, e.g. on the ground beneath, a vehicle. However, it will be appreciated than in this aspect the invention is not intended to be limited solely to minimising the effects of damage caused by "car bombs" since it can find application in other areas where, for example, it is known or suspected that the explosion or detonation of an object, structure or device will take place in the near future.

Whenever a car bomb or suspected car bomb is identified there is a need to respond quickly to the danger involved. Normally the emergency services will evacuate an area around the car bomb as speedily as possible. Once the area has been cleared, it may be desirable to deliberately explode the car bomb or suspected car bomb. The detonation of such a car bomb either deliberately by means of a controlled explosion or by the normal timed explosion of the car bomb itself can and often does cause great damage to property, and sometimes also to people in the vicinity of the car bomb. There is a need, therefore, for a protective shield to be erected around the car bomb as quickly as possible to limit or minimise the effects of a subsequent explosion of the car bomb.

Thus according to a further aspect of the present invention a method of shielding an object to minimise damage caused by a subsequent explosion in, or adjacent to the object, comprises disposing around the object a shielding structure comprising flexible liquid-filled containers which are intended to be fractured by material ejected outwardly from the object as a result of said subsequent explosion for releasing the liquid from said shielding structure.

In the case of fly-suppression, conveniently the flexible-walled containers are created from at lease one length of lay-flat plastics tubing which can be draped in zig-zag fashion down a vertical run of spaced-apart supports in such wise that separated volumes of liquid are created between each support in the vertical direction when the tubing is filled with water. One form of support takes the form of a "rope ladder", the spaced-apart vertical "ropes" thereof acting to support one or more complete runs of lay-flat tubing, the or each of which runs is located between the ropes and over each "rung" of the ladder to form a series of loops of tubing between each adjacent pair of "rungs". The lay-flat tubing and/or the ladder can be provided with attachment means at intervals therealong to secure it to the vertical "ropes", to the "rungs" and/or to the structure of the building to be demolished. Each "rung" of the ladder may be of tubular construction and is preferably of a size to permit liquid to flow easily through the lay-flat tubing draped over the "rung" when the tubing is filled with liquid from above.

Suitably where a continuous length of flexible tubing is used to define a plurality of successive liquid-filled containers disposed one after another along the length of the tubing, some means is provided to an least lightly secure parts of adjacent containers together since this helps to provide stability to the structure during filling with liquid and in the period between such filling and the detonation of the charge (s).

The shielding structure usable to protect an object liable to explode can include a plurality of flexible hollow containers which can be filled with fluid to erect the shielding structure from a collapsed condition to an erected condition. Initially, the shielding structure is intended to be positioned spaced to one side of the object to be protected in its collapsed condition and is subsequently filled with fluid or fluids to cause the shielding assembly to be positioned around the object, structure or device to be protected. In particular, it is intended that hollow flexible containers in the base part of the shielding structure are initially filled with liquid, preferably water, to form a weighted base and that a gaseous medium, e.g. air, is then introduced into the hollow containers to cause the shielding structure to erect itself up over and down the other side of the object to be protected. When so erected, the gaseous medium in the hollow flexible containers is replaced by liquid, preferably water, so that the shielding structure is completely filled with the liquid. Lines are preferably attached to the structure to enable introduction of the gaseous medium and the liquid to be performed from a safe distance from the shielding structure so that the shielding structure is erected substantially automatically from a remote location. Preferably after the liquid filling of the base of the shielding structure, a buttress of the structure is erected to one side of the object to be protected, then a roof is created and then a side wall at the other side of the object is formed. The shielding structure thus spans the object to be protected. If desired, end walls can be provided for completely enclosing the object.

The shielding structure for a potentially explosive object is conveniently formed of a plurality of flexible tubes, e.g. of polyethylene material, laid in a collapsed condition in a zig-zag mariner within an outer flexible surrounding covering, e.g. of a fabric or plastics material. When filled with fluid, these tubes are intended to automatically form the correct erected shielding structure shape which bridges over the object to be protected. When these tubes are filled with liquid, preferably water, a blanket of liquid is created around the object to be protected. If an explosion of the object occurs, the flexible material containing the liquid is intended to be fractured easily by material blasted from the explosion causing the liquid to be released to douse the explosion.

According to another aspect of this feature of the present invention there is provided apparatus for forming a protective shield around an object to minimise any damage caused by a subsequent explosion in, adjacent to, or of the object, comprising a plurality of flexible hollow members which are normally in a collapsed condition but which can be expanded, in use, when filled with fluid to create an erected structure having a base on one side of the object to be protected, a buttress extending upwardly from the base, a roof extending over the object and a side wall on the other side of the object to be protected, whereby the hollow flexible containers of said erected structure are intended to be filled with liquid, e.g. water, when the apparatus is in use to provide a liquid-filled protective shield around the object to be protected.

It will be appreciated that valving means is preferably provided to enable the introduction of fluids into the hollow flexible containers. Furthermore, valving means may be required to enable gaseous medium to be expelled from the hollow containers as liquid is introduced into these hollow containers.

A number of advantages result from the invention and included among these may be mentioned:

1. Very low cost of the equipment used.

2. Very light equipment for transport to, and erection on, site.

3. Very easy installation of the equipment on site.

4. The substantial absence of any material in the protective equipment that could itself generate fragments.

5. The release of large volumes of liquid simultaneously with and close to each detonation to assist in the suppression of noise, blast, heat and dust.

Figure 2:
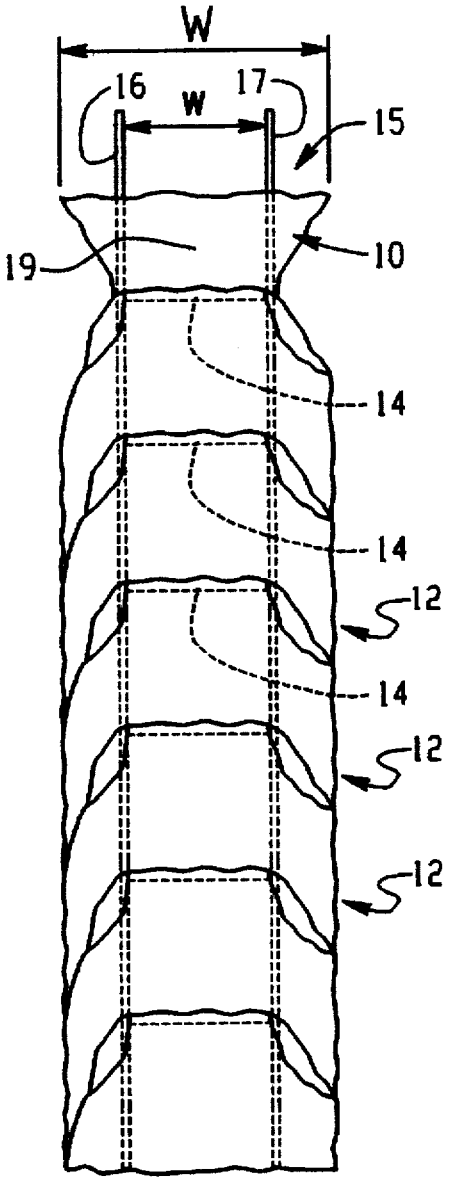
Figure 3:
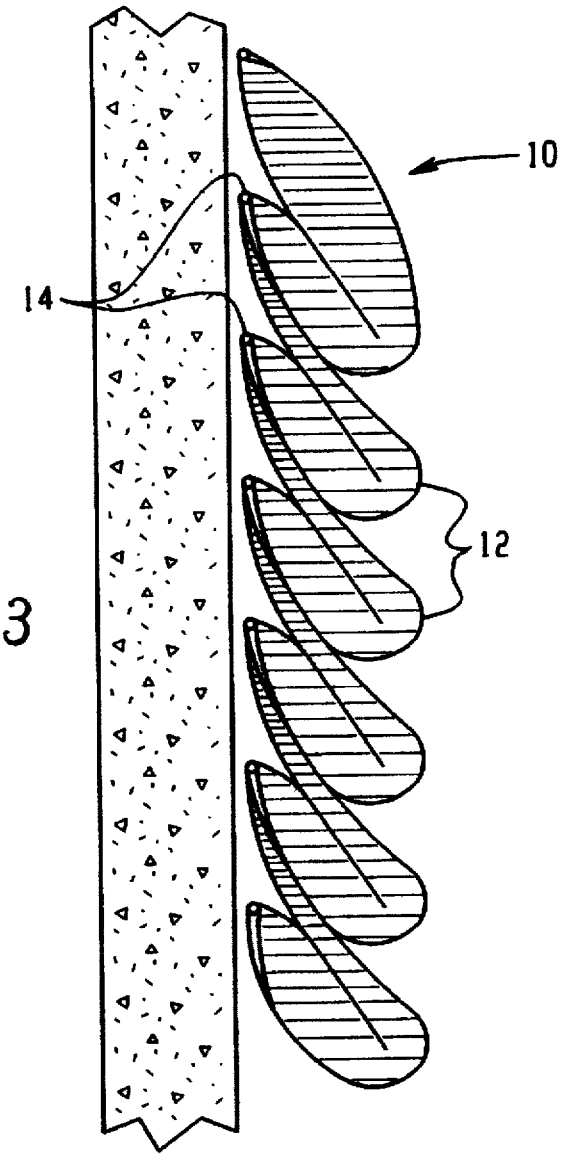
Figure 4:
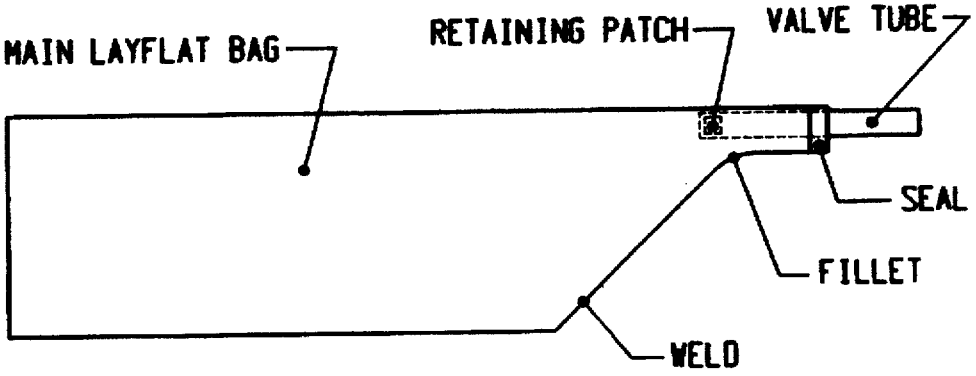
Figure 5:
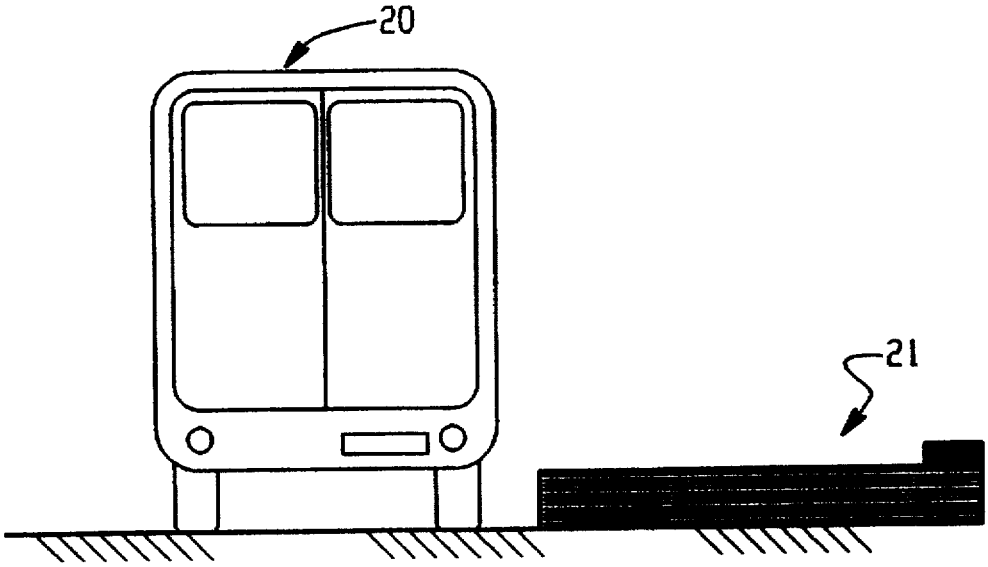
Figure 6:
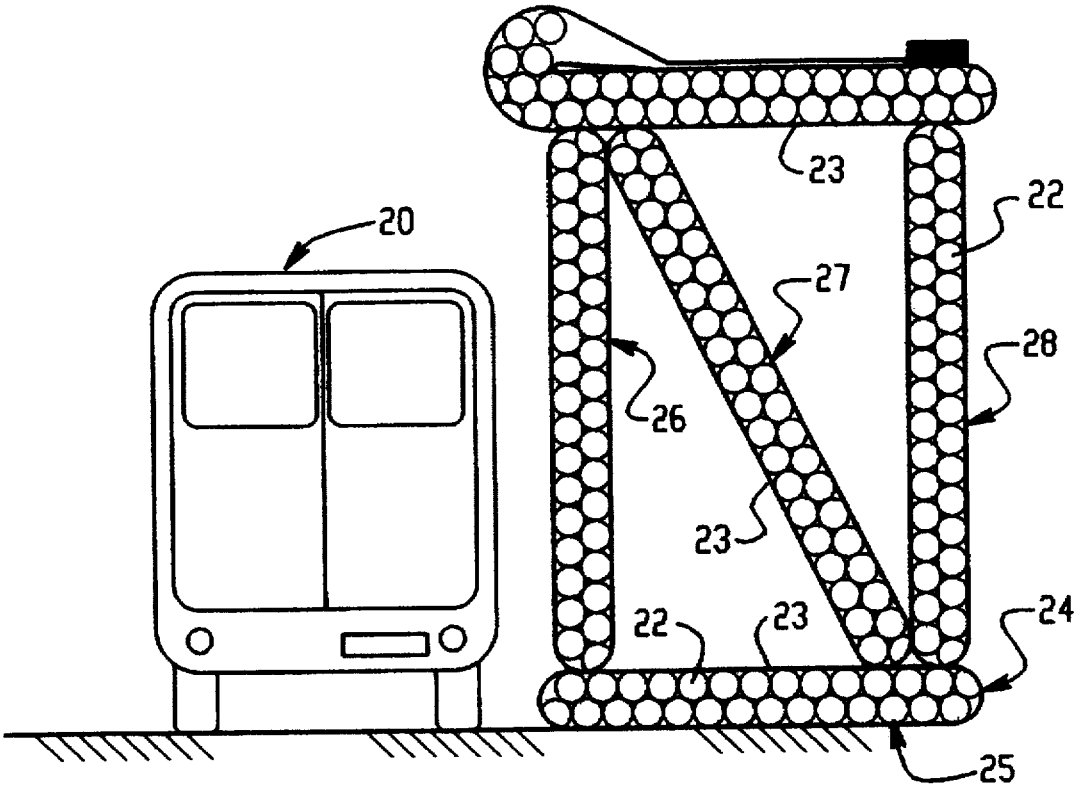
Figure 7:
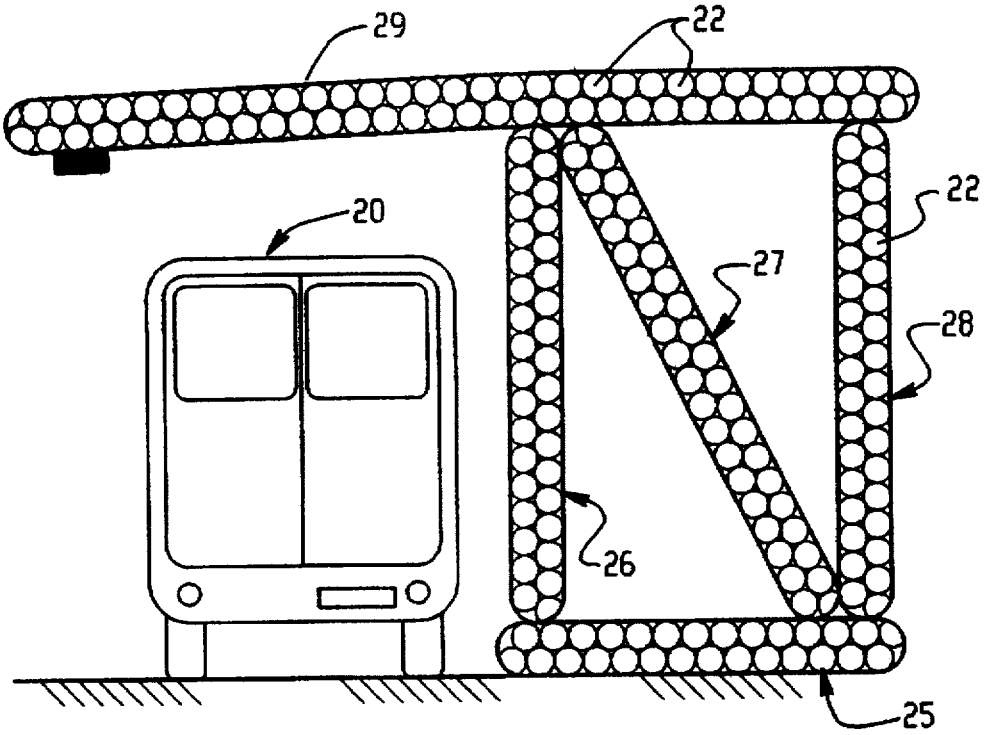
Figure 8:
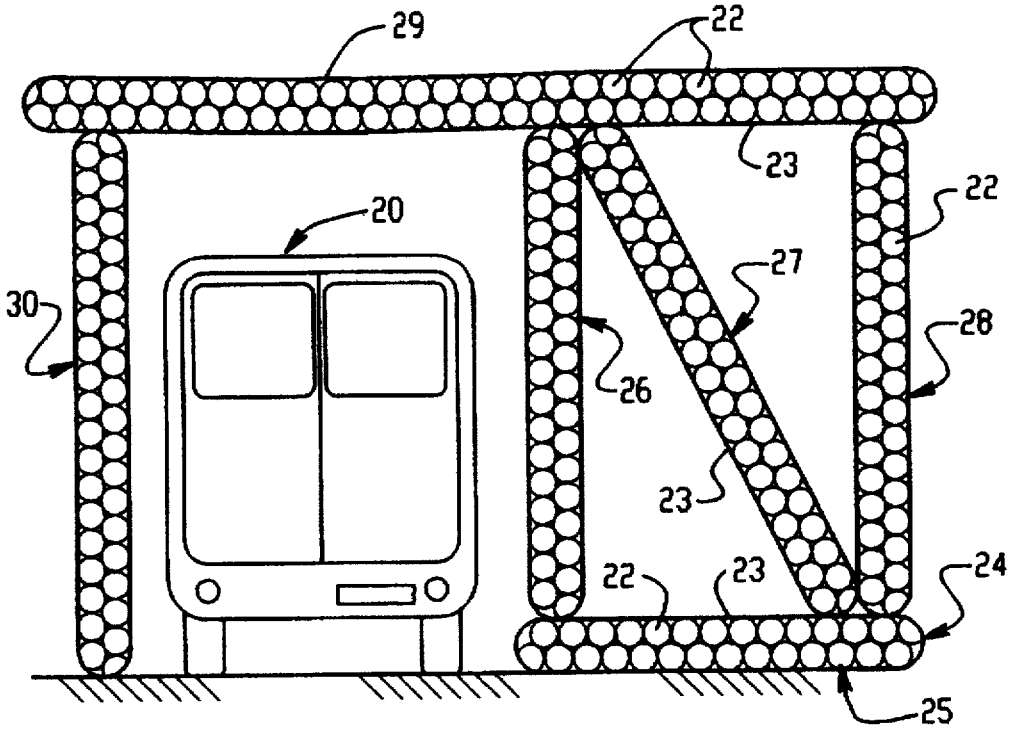
Figure 9:
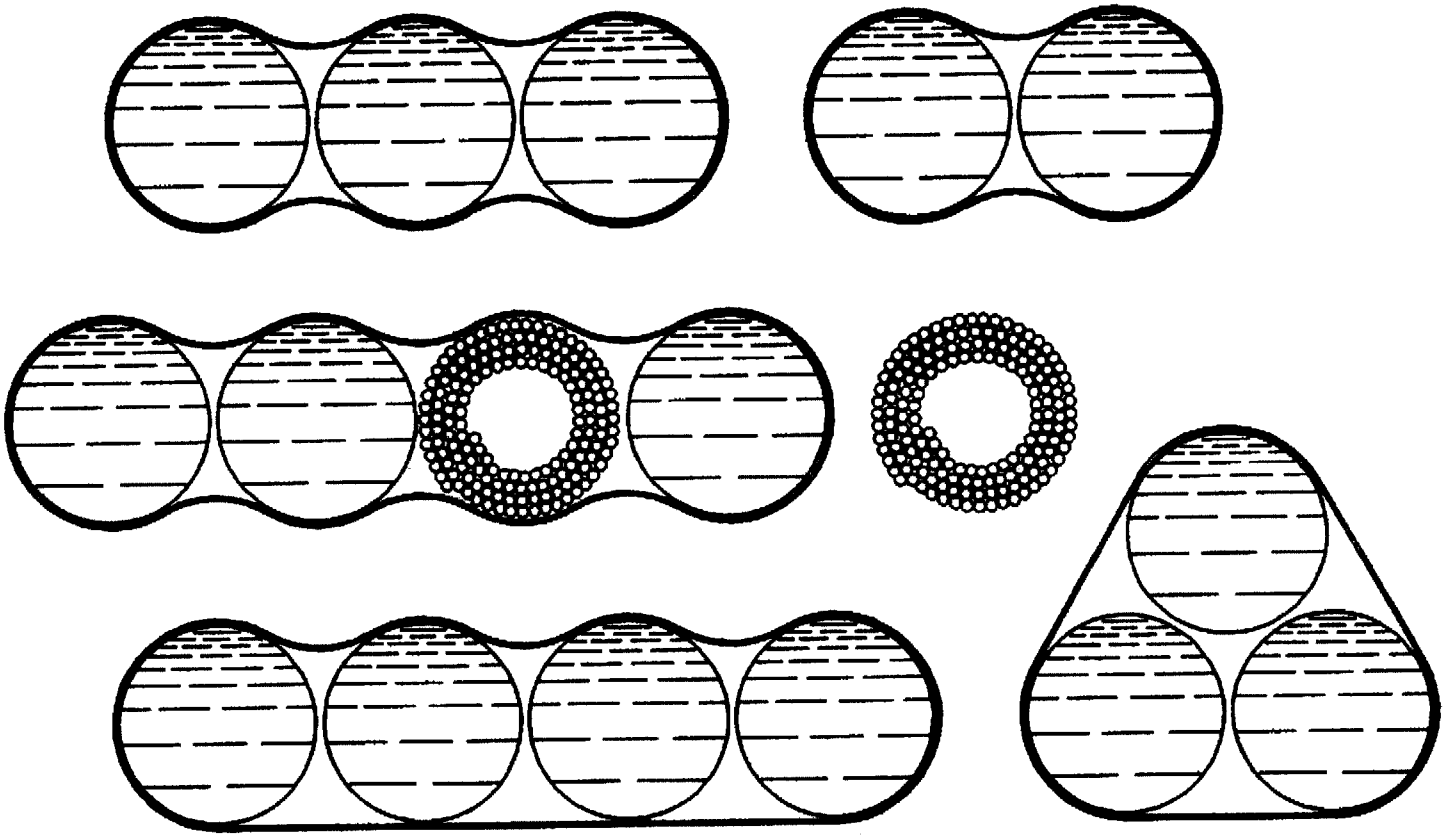
Figure 10:
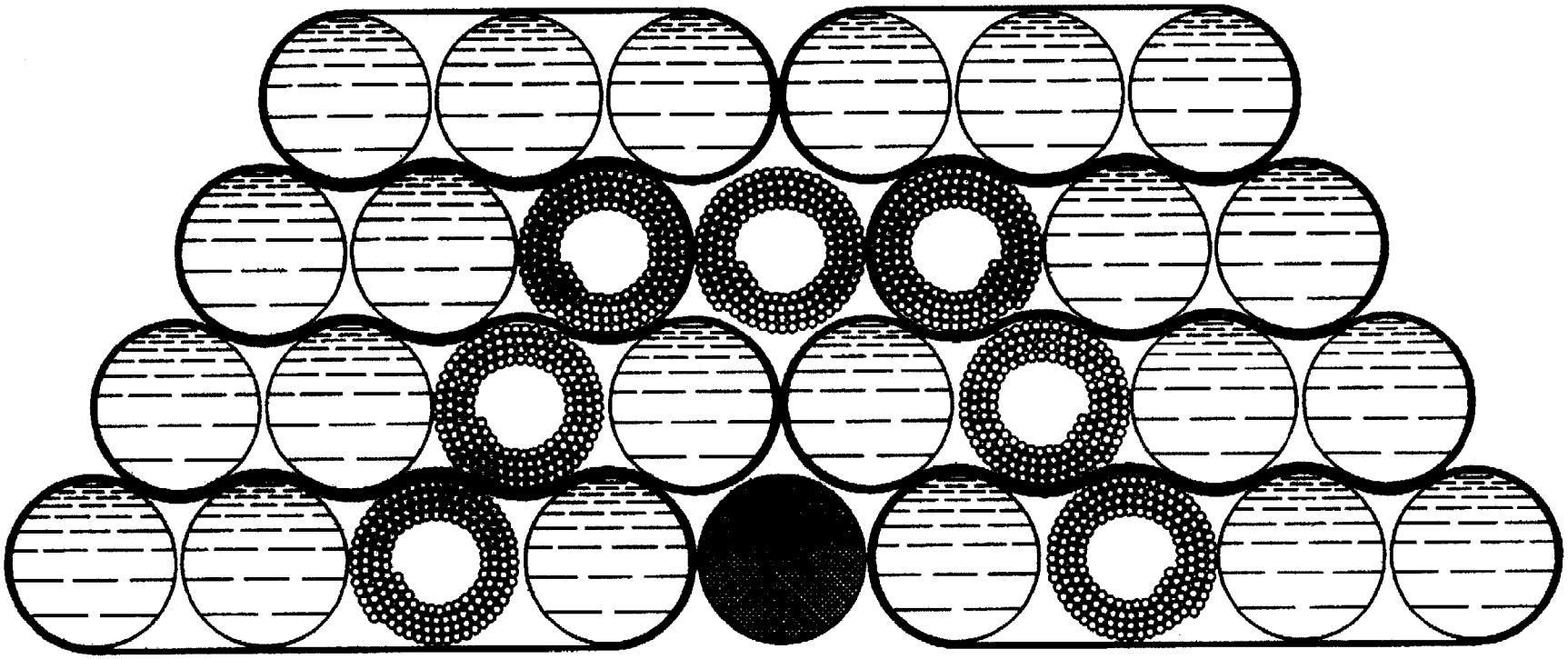

Some aspects of the invention will now be further described, by way of example, with reference to the accompanying drawings, in which:

FIG. 1 shows, in schematic side elevation, a section through equipment according to this invention filled and ready for use for "fly" suppression, FIG. 2 is a schematic front view of the equipment shown in FIG. 1, FIG. 3 shows, in side view, the equipment of FIG. 2, liquid-filed for use, FIG. 4 shows a non-return valve and welding details of a lay-flat tube, for use in the method of the invention, FIG. 5 is a schematic end view of a vehicle having apparatus according to the invention in a collapsed condition positioned at one side of the vehicle prior to erection into a protective shielding structure around the vehicle, FIGS. 6 to 8 show various stages in the erection of the apparatus of FIG. 5 into a shielding structure around the vehicle to be protected, FIG. 9 shows arrangements of liquid-filled tubes, collected in groups for creating stable building elements, for blast suppression, and FIG. 10 shows a typical stack of tubes placed around a charge to be detonated.

FIG. 1 shows a length of lay-flat tubing 10 suspended in loops 12 between "rungs" 14 of a "rope ladder" 15 only schematically illustrated (see FIG. 2). The rungs 14 of the ladder 15 are supported between flexible filaments 16 and 17 (neither filament is shown in FIG. 1). FIG. 2 shows that the natural width W of the lay-flat tubing 10 exceeds the separation w between the filaments 17 and 16 but forms a zig-zag pattern down the ladder 15 as it is doubled into the loops 12 each suspended between an adjacent pair of rungs 14. The assembling of the lay-flat tubing 10 between the rungs of the ladder 15 is effected with the tubing empty and it is therefore a relatively simple matter to fold the tubing into the required loops and support those loops one-by-one over the rungs of the ladder. The bunching of the tubing in its passage over a rung is advantageous for a purpose which will shortly be described. Desirably the folded loops 12 are secured in place on the ladder 15 and this can be achieved in a number of ways. A preferred arrangement is to adhere confronting regions of the loops 12 together (e.g. at the positions indicated by the reference numerals 18 in FIG. 1) and this securement can be achieved in a variety of different ways one such being the use of double-sided adhesive tape. It is also possible to secure the tubing 10 to each rung (e.g. also with double-sided adhesive tape) where it passes over each rung.

Once the lay-flat tubing 10 has been correctly disposed in loops between the rungs of the ladder 15, the latter can be rolled up to form a lightweight equipment package easily transportable to a demolition site where it can be unrolled for suspension in a position where it will be located between the site of an explosive charge and the area to be protected from "fly" emanating from that charge on explosion.

When located onto and fixed to the area to be protected, the tubing 10 is filled with water from above via the region indicated at 19 in FIGS. 1 and 2. The water first fills the uppermost loop 12 rising in the downstream leg in this loop until it can flow over the first rung 14. The bunched nature of the tubing in its passage over each rung facilitates the flow of water between a loop that has been filled and the next loop about to be filled. This sequence of filling continues down the run of tubing 10 until water finally fills the bottom end of the tubing indicating that the entire line of containers supported by the ladder structure 15 has been properly filled. The total weight of the structure will be a function of the width of the lay-flat tubing and its length and the breaking strain of the filaments 16 and 17 (e.g. ropes or cables) and their securement to the structure need to be strong enough to withstand the expected strains generated in use.

A significant advantage of the invention resides in the fact that although a ladder 15 may be 10, 20, 30 or even more meters in length, since the total contained volume of liquid is divided into many discrete volumes each representing one loop, the wall of the lay-flat tubing only needs to be able to withstand the maximum pressure generated in a loop 12 and each rung 14 only needs to support the weight of one loop (actually half the weight of the loops on each side). If despite this advantage the lay-flat tubing chosen for use lacks structural strength to withstand the anticipated head of water it will have to resist the pressure of, it is an easy matter to reinforce the tubing with a layer of reinforcement (e.g. strips of plastics or netting) which can be fixed to one surface of the lay-flat tubing to reinforce at least the individual loops. Thus the reinforcement can be thought of as hammocks which support the added weight. A range of different widths and lengths of ladder and interwoven lay-flat tubing can be provided so that operatives can choose the preferred width of equipment needed for each application on the site where a demolition is to occur. A length required can be cut from a longer length.

As shown in FIG. 1, at any given position along the run (apart from the uppermost and lowermost regions) there will be five adjacent layers of water-filled tubing which have to be traversed by "fly" travelling from one side of the filled equipment to the other. If this is not deemed to be a sufficient resistance for the anticipate "fly" likely to be created it is, of course, possible to hang one or more further ladders over the first ladder which is placed adjacent to the structure to be protected.

When deploying the system on a building site the operatives can readily work from a craned man-cage, a hydraulic access platform or even a bosun's chair on a rope access system. Because of the light weight of the unfilled equipment there would normally be no need to provide expensive scaffolding to enable the equipment to be fixed in place. Hilti (Trade Mark) bolts or Rawlbolts (Trade Mark) could be fixed into the masonry or steelwork of a structure to be subjected to demolition at a position well above the potential site of the "fly". The ladder 15 containing the looped lay-flat tubing 10 is then fixed to these bolts and rolled down the structure and draped flat over the targeted area. Further secondary fixings could then be provided at intervals along each side of the suspended structure to firmly secure it to the targeted area. Eyeletted lugs can be provided at intervals (e.g. adjacent to each rung or at spaced intervals along the tubing 10) to hold the structure in place when the blast occurs. The secondary fixing holes, if provided in a masonry structure, can be drilled with a lightweight hammer drill (such as rock-face climbers use) and in the case of steel columns, further fixings could be provided using explosive bolts, since the charges to be detonated will not be in position when the explosive bolts are belts used. Secondary fixings to prevent lateral movement of the equipment structure following filling with water are desirable since the blast from early-fired charges might otherwise displace a structure protecting a charge to be fired later and thereby reduce its efficacy for "fly" suppression. This problem can be severe in the case of high structures particularly if the ladder 15 and looped lay-flat tubing 10 is being used to face an external surface of a building where in might be affected by natural winds and updraughts. If securement against wind rock is not carried out in is possible for the tubing 10 to be abraded to the point where on attempting to fill the equipment with water, a leak will generate in the tubing downgrading the efficiency of the equipment.

When the equipment is deployed over window and door apertures, the fixing and hanging operation can be carried out from both inside and outside of the building structure thus ensuring the presence of a double layer of blast protection at these structurally weak points.

The ladder-based structure described can be used with water-filled blankets and water-filled panels (e.g. also created from lay-flat tubing) as circumstances require.

The rungs 14 of the ladder can be of plastics tube and their only requirement is that they be strong enough to support the weight of half the filled loops of tubing on either side thereof and that they do not themselves generate dangerous "fly". With the arrangement shown in FIG. 1, it would be desirable to have the site of the blast on the right-hand side of the structure shown since with this arrangement any material blasted from the rungs would have to pass through several water-filled layers before it was free to cause damage.

Apart from blast protection, the system described will assist in what is known as "tamping". It is fairly difficult to drill, charge and stem thinner concrete walls and other structures as the blast will often simply blow out through the other side or merely fragment localised sections of the structure and not the whole of the targeted area as intended. There are available special preformed explosive charges for blasting thinner elements and these can be used in a "lay-on" mode where the explosives are simply placed against or around a target and detonated. In this situation sand bags are widely used as an effective means of keeping the blast effect against the target and to suppress "fly" but a water-filled bag of the kind described herein could equally well be used.

The time taken to fill the equipment with water can be reduced if means is provided to prevent close proximity of the whole area of the inside surfaces of the lay-flat tubing as it passes over each rung. Several methods are possible.

The lay-flat tubing can be formed with an internal surface texture or longitudinally-extending ridge(s).

The edges can be waved or dimpled between heated rollers so as to locally extend the area.

A rope can be passed through the lay-flat tubing so as to open a passage.

At least the upper surface of the rungs can be made irregular by wrapping a rope round the rung so that the support given to the lay-flat tubing is not continuous.

The lay-flat tubing can be deliberately wrinkled so as to reduce its width where it passes over the rung. This will happen automatically if the distance w between the ropes is at least slightly less than the width W of the lay-flat tubing.

An opening member (e.g. wedge shaped) can be introduced into the inlet region 19 of the tubing 10 before the water so that it is carried down the run, loop-by-loop, by the leading edge of the water fall. The opening member can have flexible "tails" that trail behind it to ensure rung-contacting regions of the tubing remain open after it has passed.

The simplicity of fixing, hanging and subsequently filling with water many hundreds of separated volumes over the structure to be demolished will save time and labour and apart from suppressing "fly", the instantaneous release or vaporisation of the water at the point of detonation and subsequent collapsing of the structure will suppress the resultant dust cloud giving a further significant advantage.

In a typical case the ladder rungs could be tubular at 500 millimeters pitch and could have a 75 millimeter diameter with 3 millimeter wall thickness. Lay-flat tubing of 600 millimeters width is one suitable size and a separation between the filaments 16 and 17 of some 500 millimeters would be suitable for use with such tubing. However, these dimensions are purely typical and are open wide variations.

In place of a ladder structure to support the bags there can be mounted on a net (e.g. a 3 square meter net) so that the filaments 16 and 17 will be provided by the net. Support stirrups can be provided an intervals over the surface of the net and the rungs 14 serving to support the vertical runs of tubing can be slipped into the stirrups and jointed together end to end as required. FIG. 3 shows an erected and filled cascade of lay-flat tubing. A length of lay-flat is sealed at the bottom and water is pumped into the top. When the level of water in the first loop reaches the highest mesh it overflows to fill the second and so on down the cascade. By choosing the loop length and mesh spacing a large vertical range can be covered while keeping the pressure in each loop within the safe limit of polythene.

FIG. 5 shows apparatus in the form of a collapsed package 21 including flexible hollow members, typically in the form of flexible plastics tubes 22 (see FIGS. 6–8), which are encased in surrounding flexible material 23. The tubes 22 and surrounding flexible material 23 are connected in a suitable manner so that when the tubes 22 are inflated, the package 21 is erected around a vehicle 20, such as a car bomb, to be protected, into a shielding structure having the form shown in FIG. 8. Expansible packages including hollow members which can be inflated are well-known in practice (one example of such an expansible package being the well-known "bouncy castles" which are inflatable to a desired shape or form), and the design of such a shielding structure shown in FIG. 8 should not present problems to a person skilled in the art of making inflatable structures.

The tubes 22 are conveniently formed from plastics film which can be supplied as a lay-flat extrusion in long continuous rolls. Ordinary polyethylene is cheap and has proved to be a satisfactory material in use. Groups of the tubes 22 can be made in long zig-zags, bonded together and then encased in the surrounding flexible material 23, typically of fabric or plastics material.

The structure shown in FIG. 8 is created by erecting the structure in a number of specific stages. Initially a base 24 is created by introducing liquid, preferably water, into the tubes 22 contained within a base element 25. Thereafter a gaseous medium, preferably air, is introduced into the tubes 22 to inflate firstly buttress elements 26, 27 and 28, then roof element 29 and finally wall element 30. Finally, the gaseous medium in the elements 26 to 30 is replaced with liquid, preferably water, to provide a liquid-filled protective covering around the vehicle 20 to be protected.

The initial inflation of the various elements 26 to 30 creates a set of building elements such as walls, beams, arches and struts. Although the load-bearing capacity is modest, it can easily be calculated from knowledge of the tensions in the film material caused by the inflation pressure. The load-bearing capacity can be improved for horizontal members, if required, by the use of more than one layer of tubes 22 with different pressures between different layers. The sole requirement is that for each element the film should always remain in tension and than the safe film stress should not be exceeded.

The package 21 is primarily intended for providing a protective shield about a vehicle which either has, or is suspected of having, an explosive device attached thereto, contained therein or in its immediate vicinity, e.g. beneath the vehicle. In this case, the packed shape of the package 21 resembles a plastics block about the width and thickness of a mattress but several car lengths long. Its flexibility will be sufficient that it can be coiled into a roll or folded into a multiple Z-bend compact enough to be carried on a vehicle trailer. In use the package 21 is intended to be towed a safe distance from the suspect vehicle and then to be tipped-off the trailer. Lines can then be fired past the suspect vehicle with an RNLI rocket, cross-bow or the like. The lines can be used to drag the package 1 to be moved along the road in which the suspect vehicle is parked to a position to one side of the vehicle. Conveniently the underside of the pack is protected by an abrasion-resistant sheet of material, e.g. polyurethane material typically 0.25 mm in thickness. Various folded hoses for the supply of gaseous medium, preferably air, and liquid, preferably water, will trail behind the pack.

Once the package 21 is in the position shown in FIG. 5, liquid from one of the trailing supply lines is passed into the tubes within the base element 25 to expand the base as shown in FIG. 6. Standard fire appliances carry approximately 1.8 tons of water and conveniently water can be pumped directly from such a standard fire appliance to fill the tubes 22 within the base element 25 to form a firm gravity base 24.

Next the gaseous medium, preferably air, (although other gaseous media, such as helium or other inert gases, could additionally or alternatively be employed) is pumped, under pressure, typically of about 100 mbar into the remaining tubes 22 of the structure in a predetermined sequence. 50 kilowatts of pumping power from a centrifugal compressor will inflate a 25 $m^3$ structure in a few seconds. If the geometry of the structure is to be properly defined during inflation, it is desirable that one section of tube can be completely inflated before air enters the next. This can be achieved by means of plastics crimps (like those used to make temporary document bindings) between various sections. FIG. 6 shows the buttress of the structure formed and the roof partly formed. FIG. 7 shows the completed roof structure with the package to be inflated to form the nearside wall adjacent the vehicle 20 to be protected. FIG. 8 shows the completed protective shielding structure around the vehicle 20.

Once the nearside wall reaches the ground, the structure can be sequentially filled with liquid, preferably water, from ground level upwards with the displaced air being vented from the highest point or points. It will be appreciated that the lower tubes in the erected structure must have sufficient diameter and wall thicknesses suitable for supporting the gravitational head corresponding to the height of the structure. In addition venting means will need to be formed in the roof element 29 and possibly also in upper parts of the other structure elements.

The rate of filling of the erected structure will depend on the rate of supply of water. A standard fire appliance can pump 4.5 $m^3$ per minute when connected to a hydrant. However, it will probably be necessary to have pressure limiters to protect the structure and distribution manifolds to control the proper filling sequence of the tubes 22 of the structure. Effective limiters can be provided by lay-flat tubes of various lengths hoisted on a frame by a fire ladder. Any distribution manifold should have a quick attachment to the bank of water outlets of the fire appliance.

With the apparatus described, it is desirable to obtain a complete surrounding of the suspect vehicle with at least a modest thickness of water and then to increase the thickness of water in further tubes if time allows. It is believed that protection from one tonne of explosive could be provided by 25 tons of water taking only about 5 minutes to be pumped into the tubes 22. If water can be initially directed to the center of the structure, the same protection will be provided only two minutes after pumping starts or even less if water can be supplied from both directions. If time allows, the degree of protection can be further increased.

The apparatus described with reference to FIGS. 5 to 8 has been designed to the following specification:

It should cover the target with a protective tunnel several car-lengths long with the option of end closures.

It shall be deployed in the shortest possible time e.g. a few minutes.

It should contain no components such as nuts and bolts which could act as shrapnel in an explosion.

It must be deployed from only one side of the suspect vehicle despite other parked vehicles.

No personnel should need to approach the suspect vehicle.

Access for bomb-disposal robots should not be prevented.

Its stored volume and length should be very low so that it can be towed by most vehicles.

It should make maximum use of the existing equipment of the emergency services.

It should suppress the effects of at least one tonne and preferably more of a modern explosive.

Its cost should be low enough that units can be deployed at many points in target cites so that rapid arrival at site can be achieved.

The training needed by the emergency services should be reasonably low.

The storage life should be several years.

It should reduce damage to adjacent property and risk to life by a factor of at least 10.

Operation should not be prevented by high winds.

No part of the structure should touch the suspect vehicle.

It will be realised that in its simplest form this aspect of the present invention relates to a method and apparatus for creating a structure around any object, typically a car or other road vehicle, which provides a protective shield around the object to minimise any damage caused by a subsequent explosion in, or adjacent to, the object. The protective shield contains liquid, preferably water typically supplied from the mains. If the object to be protected subsequently explodes, the structure is desired so as to be fractured by "fly" from the explosion to cause release of the liquid contained in the protective shield. The protective shield is preferably formed from relatively cheap material, such as plastics film in tube form which can be laid flat in a tortuous path in its stored or collapsed condition. When expanded, the tubular film material forms a desired structural shape bridging over the device to be protected.

The invention also extends to clustering liquid-filled flexible containers (or bags) around devices to be deliberately exploded. Such devices could be an unexploded bomb discovered on a building site or unwanted munitions that have to be destroyed. These applications may also require special arrangements of groups or sub-groups of bags.

There are three options for connecting groups or sub-groups of bags. They can be arranged within a casing in a multiple Z-fold and fill them sequentially from one end. This requires the least number of hose connections but it can take a long time for water to get round the bends of a Z-fold and attempts to force it too quickly can burst the first bag. A Z-fold system must be filled slowly.

Although lay-flat tubing is very cheap it does not offer convenient connections to hoses, which are needed in larger numbers for parallel filling. Hard or heavy hose fittings should be avoided because of the need for flat packing and the need to avoid hard fragments that could be thrown out by the explosion. A parallel connection can be made by joining two bags with glue, by hot welding or with patches of double-sided adhesive and then punching holes within the area of the patch. This can be done with a stack of many tubes.

It is convenient for training and experimental work to fill and empty individual bags and it can also be useful to control the amount of air in them either by bleeding off excess dissolved gases often found in hydrant supplies or by deliberately adding extra air to some tubes. The entry mechanism should allow bags to be stacked flat or rolled for compact transport.

A suitable design, shown in FIG. 4 is to cut the lay-flat tubing along an oblique line leaving a fillet to a short tongue about 120 mm wide. The bag is then welded along the cut leaving the square end of the tongue open. A length of much narrower lay-flat with a retaining strip of double-sided adhesive tape is then passed inside the tongue and the tongue ends are sealed around it. Any pressure inside the bag will close the narrow lay-flat but it can be opened by the insertion of a hollow probe. The seal is not quite perfect by the leakage rate for water is acceptable and the leakage rate for air can be kept to the same value by having the entry at the lowest part of a bag and putting in some water with the air.

In urban applications bags will often be filled from fire hydrants which can supply water an pressures far greater than the bags can resist. A convenient pressure limiter can be made by using an open-vertical PVC pipe about 200 mm in diameter with a height corresponding to the required relief pressure. This will also remove gas bubbles from the water stream. These may be wanted in bags near charge but not in those furthest away.

The behaviour of explosives and the transmission of shock waves through air and through water have been the subject of intensive study for many years and the results are now well known. Except in the region very close to the explosive charge, the velocity of propagation of a shock wave depends on the square root of bulk modulus over density. For water this is about 1500 meters per second. For a gas the bulk modulus is the product of pressure and the specific heat ratio (1.4. for air). Both the density and the bulk modulus of a gas rise directly with pressure so this has no effect on the speed of sound. Temperature changes at constant pressure do change the density and so the speed of sound rises with the square root of absolute temperature. At 0° C. the velocity in dry air is 331 meters/sec. At 3000° C., about 11 times hotter on the absolute temperature scale, it would be 3.3 times faster, i.e. 1100 meters per second. Higher speeds occur for the lighter gases like carbon monoxide and steam which are produced by explosions.

Things get more interesting if there are bubbles of air in water or drops of water in air. If these are small compared to the wavelengths of sound, the air bubbles give a great reduction of bulk modulus but not so much reduction in the density.

Shock waves with the magnitude of explosions will of course squash the bubbles to very small volumes but the water around them has to be given kinetic energy to move into the bubble space and then again when the bubbles bounce back. Furthermore squashing bubbles makes the air in them very hot and so water can be evaporated. There is also the interesting result that the back of the shock wave, where compression has reduced the volume of bubbles, ought to be travelling faster than the front where the bubbles have not yet been compressed. This makes for very high pressure gradients which are associated with large internal losses.

Some very interesting hydrodynamic behaviour would be produced if it were possible to release something like powdered Alka-Seltzer (RTM) tablets evenly through the water bags a shorn time before a charge is exploded. An alternative arrangement is to rely on physical bubble placement. Fortunately the use of multiple-bag construction allows a way to do so.

The fraction of interstitial space between close-packed cylinders in a hexagonal array is $$\sqrt{3} - \frac{\pi}{2} \approx 0.161$$

This will be reduced if non-rigid water bags bulge into the interstices but about 10% of included air can still be expected.

This percentage can be increased using another polythene product known in the UK as "Bubble-Pack". It is produced as a packaging adjunt and consists of a dimpled layer of polythene bonded to a flat layer of polythene. Typical dimples are 25 mm diameter cylinders 10 mm deep. By enclosing rolled-up bubble-pack in water bags or by wrapping bubble-pack round them the fraction of enclosed gas can be increased as much as desired. The best fraction is not yet known but 20% to 30% for the region near the explosive seems a reasonable guess. Larger gas fractions can be included by the injection of nitrogen from gas cylinders or gas from the exhaust of a support vehicle into selected bags.

FIG. 9 shows some arrangements of groups of liquid-filled bags contained in a common casing of plastics sheeting. Rolls of "Bubble-Pack" are also shown in some bags.

Since it is desirable no achieve a high degree of mixing between gases and water, with room for the water to break up into small drops with a large surface area, the air to water ratio at a chosen distance from the explosion should be increased. This can be arranged by using air bags containing Bubble-Packs as shown in FIG. 10. Note that lines drawn from the center of the explosive charge (shown black in FIG. 10) pass through alternating water, air and then water compartments. The air space is meant to be a mixing chamber close enough to the charge for temperatures and pressures to be high but with space enough for the separation of water drops. Any pair of paths with different speeds of particle movement should produce vortices which are good for local energy dissipation and for helping the mixing processes.

The following Examples further illustrate the invention.

EXAMPLE 1

Two identical reinforced-concrete wall-partitions in a nuclear command bunker were prepared for demolition, one was protected by water-filled bags, the other was unprotected. Holes for charges were drilled and target boards placed opposite to them. The charges were fired. A board 4 meters from the protected wall was unmarked by the explosion debris. The unprotected board had fist size penetrations over its entire area. Concrete fragments on the unprotected wall were scattered all over the bunker with many impacts on wall and ceiling. Most of the "fly" on the protected side was deposited in a neat pile close to the foot of the demolished wall.

EXAMPLE 2

One side of a concrete block in a quarry was protected with water-filled bags leaving the other side exposed. Scrap cars with opened doors were placed at 5 meters on each side of the block. The explosion of 6 borehole charges in the center of the block sent concrete fragments clear through the car on the unprotected side emerging from the trunk. None of the windows of the car on the protected side was even damaged. Concrete fragments were found at distances up to 110 meters on the unprotected side but no more than 6 meters on the protected side.

EXAMPLE 3

In an open field trial, a protected blast of 10 kg of Gelamax (TM) was compared with 1 kg of an unprotected one. At a range of 150 meters down wind (about 5 m/sec) using a Bruel and Kjaer 2218 sound level meter (which records down to 50 microsecond rise times) 136 dB with linear weighting was measured for the 10 kg charge and 139 dB for the 1 kg one. Ten times the charge weight thus produced 3 dB less pressure. Three experienced explosives engineers through at first that the protected charge must have misfired. A pair of Anderson paper gauges at 6 meters from the 1 kg charge had burst panels corresponding to 4.1 psi (28.2 kPa) but the 0.9 psi (6.2 kPa) panel was unmarked on the protected 10 kg charge. The furthest fragment of earth from the protected charge was thrown 14 meters but the crater diameter was 2.75 meters, about 50% greater than expected.

We claim:

1. A method of shielding a given location from the effects of detonation of explosive material comprising the steps of; placing at least one blast-absorbing device between the explosive material and the given location and allowing energy resulting from detonation of the explosive material to be absorbed by said at least one blast-absorbing device characterized in that the blast-absorbing device includes a plurality of rupturable flexible liquid containment sections, each of said containment sections being independently suspended from support members and arrayed in a vertically extending relationship, further characterized in that each said device with the containment sections vertically arrayed is placed proximate to the explosive material and between the explosive material and the given location to be shielded and in that each said device is then filled with liquid.

2. The method of claim 1 characterized in that said containment sections are connected to each other and have fluid interconnection therebetween to facilitate liquid filling.

3. The method as defined in claim 2, characterized in that said explosive material is located in a vertically extending structure; and the method includes connecting said devices to said vertical structure in a supported relationship thereon.

4. The method as defined in claim 3, characterised by the steps of connecting a supporting member to said structure, and supporting each of said containment devices on said supporting members.

5. The method as defined in claim 1 when used to prepare a building structure for explosive demolition characterised by locating empty flexible-walled containers between at least one site of an explosive charge in the structure and its surroundings, introducing a volume of liquid into the flexible containers to expand them and subsequently detonating the charge.

6. A method according to claim 1, characterized in that the at least one liquid containment device is a length of lay-flat plastic tubing folded into said containment sections.

7. A method of suppressing blast from a detonated explosive charge which comprises covering the charge with a liquid-filled containment device prior to detonation, characterized in that the containment device comprises a stack of liquid-filled tubes each made from lay-flat plastic tubing, the innermost tubes being in contact with the charge and wherein each tube is independently filled with liquid and the liquid therein isolated from the liquid in each other tube by interconnecting supporting structures.

8. A method according to claim 7, characterised in that the tubes are collected in groups to create stable building elements for the stack.

9. A method according to claim 8, characterised in that air compartments are formed in the building elements.

10. A blast suppressing structure comprising a volume of water adjacent to an explosive charge to be detonated, characterized in that the water is contained in flexible bags assembled in groups to create stable building elements, and wherein the water in each flexible bag is separated from the water in each other flexible bag by interconnecting supporting structures, a plurality of such building elements being placed one adjacent another to surround the explosive charge to be detonated so that a straight line drawn outwardly from the centre of the charge passes through alternating water, air and water compartments.

11. A method according to claim 10 characterized in that each bag is filled from one end via a narrower lay-flat valve tube sealed to ends of an open tongue left in one corner of the bag, the valve tube being closed by pressure within the bag.

12. A method according to claim 10, characterized in that each tube is liquid filled via a valve tube made from a narrower lay-flat plastic tube sealed to pass through an otherwise closed end of the tube.

13. A building element for creating a containment device to limit the noise and blast following detonation of an explosive charge surrounded by the containment device, characterized in that the building element comprises a plurality of closed lengths of lay-flat plastic tube each length being provided with a valve tube for independently filling said length with liquid, said plurality of lengths being contained in a common casing of plastics sheeting and interconnected by supporting structures.

14. The method of claim 3 wherein said support members include a flexible ladder structure, having a plurality of rungs and side filaments, and said containment sections are supported on said rungs of said ladder.

15. The method as defined in claim 14 wherein the side filaments of said ladder are secured to the vertically extending structure.

16. The method of claim 14 wherein each of the containment sections is looped over the rung supporting said section to thereby define two fluid containment cavities for each section supported by each of said rungs.

17. Apparatus for forming a protective shield around an object to minimize any damage caused by a subsequent explosion in, adjacent to, or of the object, comprising a plurality of flexible hollow containment sections which are normally in a collapsed condition but which can be expanded, in use, when filled with fluid to create an erected structure having a base on one side of the object to be protected, a plurality of support members, each of said sections being independently supported by one of said support members and wherein the hollow flexible containers are configured to be filled with liquid, when the apparatus is in use, and to be positioned adjacent said object to provide a liquid-filled protective shield around the object to be protected.

18. The apparatus of claim 17 wherein said support member includes a flexible ladder structure having a plurality of rungs and side filaments, and wherein said containment sections are supported on said rungs of said ladder structure.

19. The device as defined in claim 18 wherein the side filaments of said ladder are configured to be mounted on a vertical support structure.

20. The apparatus of claim 18 wherein each of the containment sections is looped over the rung supporting said section to thereby define two fluid containment compartments for each section supported by said rungs.

* * * * *